US008819948B2

(12) United States Patent
Chamberlain

(10) Patent No.: US 8,819,948 B2
(45) Date of Patent: Sep. 2, 2014

(54) METHOD AND APPARATUS FOR TRANSCRIBING A PROFILE

(75) Inventor: Peter Anthony Chamberlain, Torquay (AU)

(73) Assignee: Thingamajig Pty Ltd, Torquay (AU)

( * ) Notice: Subject to any disclaimer, the term of this patent is extended or adjusted under 35 U.S.C. 154(b) by 204 days.

(21) Appl. No.: 13/383,607

(22) PCT Filed: Jul. 28, 2010

(86) PCT No.: PCT/AU2010/000947

§ 371 (c)(1),
(2), (4) Date: Jan. 12, 2012

(87) PCT Pub. No.: WO2011/011819

PCT Pub. Date: Feb. 3, 2011

(65) Prior Publication Data

US 2012/0124847 A1 May 24, 2012

(30) Foreign Application Priority Data

Jul. 28, 2009 (AU) ..... 2009903508

(51) Int. Cl.
*B43L 13/02* (2006.01)
*B25H 7/04* (2006.01)

(52) U.S. Cl.
CPC ..... *B25H 7/04* (2013.01); *B43L 13/028* (2013.01)
USPC ..... 33/41.5; 33/41.6

(58) Field of Classification Search
USPC ..... 33/41.5, 41.1, 41.6, 194
See application file for complete search history.

(56) References Cited

U.S. PATENT DOCUMENTS

| | | | | | |
|---|---|---|---|---|---|
| 1,835,822 | A | * | 12/1931 | Stutzenstein | 33/41.1 |
| 1,970,476 | A | * | 8/1934 | Schutze | 33/41.1 |
| 2,087,188 | A | * | 7/1937 | Fulton | 33/41.5 |
| 2,119,852 | A | * | 6/1938 | Corbin | 33/41.6 |
| 2,287,601 | A | * | 6/1942 | Callaghan | 33/41.5 |
| 2,509,876 | A | * | 5/1950 | Neiss | 33/41.5 |
| 2,581,179 | A | * | 1/1952 | Eldh | 33/41.5 |
| 2,581,534 | A | * | 1/1952 | Hungerford | 33/41.5 |
| 2,870,539 | A | * | 1/1959 | Zaccone | 33/41.1 |

(Continued)

FOREIGN PATENT DOCUMENTS

| | | | |
|---|---|---|---|
| DE | 2334221 | A1 | 1/1973 |
| FR | 2589383 | A1 | 5/1987 |

(Continued)

OTHER PUBLICATIONS

PCT, Title: International Preliminary Report on Patentability & Written Opinion, dated Jan. 31, 2012, pp. 1-8.

*Primary Examiner* — Christopher Fulton
(74) *Attorney, Agent, or Firm* — Sutherland Asbill & Brennan LLP

(57) ABSTRACT

The present invention relates to the field of cabinetry, cabinet making and the building industry in general. In particular, the invention relates to a method and apparatus for transcribing a profile of a reference surface onto a target surface. In one form, the present invention provides a scribe tool that may include at least one marking portion operatively associated with a reference surface following portion, the at least one marking portion extending laterally beyond the perimeter of the reference surface following portion and may include at least one marking region forming an angle of about 90° or less at its outer extent.

13 Claims, 2 Drawing Sheets

(56) References Cited

U.S. PATENT DOCUMENTS

| | | | | |
|---|---|---|---|---|
| 2,894,329 | A | | 7/1959 | MacDermid |
| 2,968,098 | A | * | 1/1961 | Collin ..... 33/332 |
| 3,875,664 | A | * | 4/1975 | Diner ..... 30/164.9 |
| 4,161,821 | A | * | 7/1979 | Miller ..... 33/41.1 |
| 4,656,744 | A | * | 4/1987 | Decker ..... 33/41.5 |
| 5,862,601 | A | | 1/1999 | O'Brien et al. |
| 2007/0033886 | A1 | | 2/2007 | Friegang |

FOREIGN PATENT DOCUMENTS

| | | | |
|---|---|---|---|
| GB | 173379 | A | 1/1922 |
| GB | 672038 | A | 5/1952 |
| GB | 2403925 | A | 1/2005 |
| JP | 05146557 | A | 6/1993 |

* cited by examiner

METHOD AND APPARATUS FOR TRANSCRIBING A PROFILE

RELATED APPLICATIONS

The present application claims priority to Australian Provisional Patent Application No. 2009903508 in the name of Thingamejig Pty Ltd, which was filed on 28 Jul. 2009, entitled "Method and Apparatus for Transcribing a Profile" and the specification thereof is incorporated herein by reference in its entirety and for all purposes.

FIELD OF INVENTION

The present invention relates to the field of carpentry, cabinet making and the building industry, in general. In particular, the invention relates to a method and apparatus for transcribing a profile of a reference surface onto a target surface. In one particular aspect the present invention is suitable for use in carpentry trades when fitting a cabinet to a floor, wall or ceiling, however it should be appreciated that the present invention is not limited to that use, only.

BACKGROUND OF INVENTION

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

In carpentry, cabinet making and the general building Industry, the construction materials used are frequently required to be fitted together as well as fitted to existing structure such as floors and walls. Accurate fitting of materials to one another in particular the fitting to existing structure(s) requires craftsman's skill. Accordingly, well fitted materials and components may be representative of quality workmanship. Accurate fitting of building materials and components to one another may be of particular importance to interior elements, such as cabinets, because, they are viewed from close range. Owners and users of interior components such as cabinets prefer the appearance of accurately fitted together joints and seams. Where bench type units are fitted to the floor, the accuracy of the fitting has additional importance as it influences the function of the bench top in terms of being level as well as the aesthetic appearance.

When fitting joinery in domestic and commercial structures for example, the installer may need to overcome the imperfections and undulations in the surfaces the joinery is being fitted to. For an acceptable fit, the installation of cabinetry to existing structure such as floors, walls and ceilings for example may require the installer to transcribe the profile of a reference surface of the existing structure to the cabinetry being fitted. This profile is often transcribed onto the target part of the cabinetry to be fitted to the reference surface. The cabinetry is then formed (i.e. cut, planed, or otherwise trimmed) to follow the transcribed profile and thus accurately fit the reference floor, wall or ceiling surface so there are no substantial gaps.

There are a number of ways to transcribe a reference surface profile onto the target part of a cabinet for Instance, but these may be done on an 'adhoc' basis and there are currently few commercially available tools to do this.

In one example, when fitting a kick rail (the base rail that cabinets such as cupboards, benches, entertainment units and shelving sit on), the top edge is generally required to be level as this is the foundation for the cupboards and bench tops. To fit a kick rail, ordinarily it is placed on the ground and a spirit level is used to level it from left to right and from front to back. If the floor is not level, the kick rail is held in a temporary level position by the installer using a series of fillers/packers of different thicknesses placed under the kick rail to hold it in this level position. The thickness of the gap between the floor and the kick rail may vary depending on the undulations and levelness of the floor.

The next stage requires the installer to transcribe the floor undulations and levelness (its profile) onto the kick rail. This is usually done by first finding the maximum gap between the floor surface and the underside edge of the kick rail. Depending on the state of the floor and length of the kick rail, this gap could be from about 1 millimeter to over about 25 millimeters.

The installer may then find a material or a combination of materials/packers to equal or slightly exceed that maximum gap. For example, if the maximum gap is 8 millimeters, the installer may use a small block of about 5 millimeter thick craftwood and 3 pieces of about 1 millimeter thick laminate=approximately 8 millimeters total height. The installer then places these packers on the floor so they are almost in contact with the vertical surface of the kick rail. The installer then places a pen/pencil or a knife blade on top of the pile of packers with the end making contact with the vertical surface of the kick rail. In one hand the installer holds the pen/pencil or knife blade and in the other he/she drags the pile of packers along the floor surface. The packers rise and fall as they move along the undulations of the floor, with the pen/pencil or knife blade transcribing an image of these undulations onto the surface of the kick rail.

This is done along all target "fitting" surfaces of the kick rail including corners and internal corners that are to come into contact with the floor. The installer may then use an electric planer or jigsaw to cut the kick rail to the profile lines that have been marked thereon. Once completed the kick rail now conforms to the floor undulations and the top of the kick rail provides a substantially level structure for the cupboards to sit on.

The above process may also be used when fitting a vertical seen end panel to a wall. A similar process may also be used for fitting bench tops up against walls and filler panels between cupboards, ceilings and walls.

When fitting a bench top to the surrounding walls, the bench top is set so it is substantially parallel or square to the front and/or ends of the cupboards. There may be an overhang over the front of the cupboard depending on the look and application trying to be achieved. Once the bench top is set in the desired position, the same process of finding the maximum gap is utilized, but this time the gap is between the edge of the bench top and the wall. Packers are again used to make up the same thickness as the maximum gap and these are slid along the wall surface with a pen, pencil or knife blade resting on them and marking the wall profile to the bench top, where it may be trimmed to fit the wall.

Another component used in cabinetry that may need to be fitted to walls, floors and ceilings is a filler strip.

Rather than having a cabinet carcass butt directly up against a wall, a filler strip is often, utilized for a cleaner finish, thus allowing it to be fitted to the shape of the wall floor or ceiling. The use of a filler strip also prevents the binding of adjacent doors on the wall surface. In most cases this can be fitted to an already levelled part of the cabinetry, as fitting filler strips is one of the finishing touches to the cabinet fitting process. The filler strip is generally fixed to parts of the cabinetry, e.g. a cabinet carcass that is to be fixed parallel to a wall, generally within about 16-20 millimeters of the wall. With the cabinet carcass sitting on a level kick rail, it is slid until the scriber or filler strip butts hard up against the wall. If there are no gaps, the cabinet carcass is then fixed to the kick rail and/or wall. However if there is a gap, the maximum gap is found, packers are used to obtain the same or slightly larger measurement as the maximum gap, and then the pen, pencil or knife blade is used to transcribe the wall profile onto the filler strip so that it can be trimmed to fit the wall. After cutting, the filler strip is fixed to the cabinetry carcass and the carcass is now ready to be fixed to the kick rail and wall.

A further application where a profile may be transcribed is in relation to skirting boards. Generally when fitting skirting boards to a wall and floor, the skirting board is cut to the desired length, then nailed to the wall where it meets the floor. If the are undulations in the floor, pressure may be placed down onto the skirting board to fit these undulations, then it is nailed and held in this position. However if the undulation are sharp angles or too high or deep, the skirting board needs to be trimmed to fit these undulations.

The above methods may be used on a wide variety of materials including and not limited to timber, particle board, Medium Density Fibreboard (MDF), laminate, stone, stainless steel and linoleum.

There are numerous problems with the above related art devices and methods including:

1. If a pencil is used it may become blunt, therefore leaving a wide line to cut to which leads to inaccuracy. Further, with a pencil becoming blunt as the image is transcribed it may cause the line to change thickness and thus after the ability to trim to the correct part of the line.
2. The packers are prone to move and slide in relation to one another particularly if there is more than one material being used Generally, movement of packers while marking prevents accurate transcribing of the reference surface to the target surface.
3. There are many moving parts, for instance, a number of packers, a pen/pencil or knife blade & the use of two hands, leading to inaccuracy.
4. Two hands are required to transcribe the profile. It is difficult to get both hands moving together while holding different things together, especially due to differing frictions being caused by different pressures being applied by the two hands.
5. If a pen or pencil is used, it is difficult to see the transcribed profile line on dark coloured surfaces, making the line hard to cut to.
6. When trimming the material to be fitted, dust lands on the target surface covering the pen/pencil line. In wiping the dust off, accidental rubbing off of the line can also occur.
7. The separate nature of the multiple packers and pen/pencil means the installer may not be able to perfectly retrace the same path on the reference surface, so the profile must be transcribed correctly the first time it is attempted.
8. Marking the profile becomes difficult when getting close to a corner due to its two handed use.
9. The process may be unsafe, particularly when the user may be standing on a ladder to mark high vertical seen end panels for example, as it requires the use of both hands therefore not allowing the installer to use one hand to steady themselves on the ladder.
10. A further safety, issue arises when using a knife or blade to transcribe an image of the reference surface. It can become and OH&S issue when using an exposed sharp blade in close proximity to the hand holding the packers. This becomes dangerous when the hand holding the packers may stop due to the packers getting caught and stopping by way of catching onto imperfections on the reference surface. Further, the hand holding the sharp blade may continue along and make contact with the hand that has stopped.

It can generally be stated that the problems associated with transcribing a profile of a reference surface onto a target surface relate to; the initial locating and then holding of the marking point, fine adjustment of the position of the marking point, range of locating and adjustment of the marking point, ergonomics, accuracy, stability, avoiding scratching or damaging the reference surface, and marking the required profile into internal corners.

With respect to locating, adjustment and holding of the marking point, because the maximum gap distance between the reference surface and the edge of the target surface is variable depending on the topology of reference surface, it would be desirable if the requisite distance between the marking point and the reference surface Could be easily located and/or adjustable within a reasonable range and then have the relative separation between the marking point and reference surface being capable of being held in a constant fashion at that distance whilst the act of transcribing proceeds.

With respect to fine adjustment, an ability to finely adjust the distance between the marking point and the reference surface is beneficial as it may lead to a more accurate final fit once the material is trimmed to the reference line.

Regarding the range of adjustment, an ability to transcribe a profile where the maximum gap between the reference surface and the edge of the target surface is less than about 25 millimeters is beneficial as this distance may be required depending on the reference surface and related art methods to date are not considered reliable for transcribing in such small separations.

With respect to ergonomics, it should be noted that transcription of the profile is mostly done in close physical proximity to the reference surface itself. The reference surface may be difficult to access and necessitate working in a prone position or upon access equipment (for example, a ladder), therefore it would be desirable to provide a means of transcribing which provides ease of use and without the need for substantial dexterity be that with one or two hands.

It is considered that inaccuracy in the transcribed profile may occur partly as a result of the unwarranted pivoting of the marking point of related art devices relative to the reference surface during use.

Reference surfaces may have a damageable finish, such as paint, so they may be susceptible to undesirable marking or damage by related art transcribing devices.

The target surface, or formations proximate thereto, or the reference surface, or a combination thereof, may form a corner which hinders prior art devices from marking the profile completely and/or accurately.

U.S. patent application Ser. No. 11/458,801 (Publication No. US2007/0033886A1), to Friegang, discloses a clamping and holding system for a filler strip, prior to it being scribed. It can not be used for kick rails and is designed to be used in conjunction with the device of U.S. Pat. No. 5,013,196 being an offset router and guide wheel, discussed below. It is considered that the clamping and holding device of Friegang may also be used in conjunction with a traditional method of scribing, as shown in FIG. 5 of Friegang. A further drawback with this holding tool is that it requires the trim strip to be machined with a tongue and groove shape due to the design of the holding tool. The disclosed holding tool is not suitable for use with cabinetry units which do not utilise a machined tongue and groove to affix the trim strip to the cabinet.

U.S. Pat. No. 5,013,196, also to Friegang (Friegang II), has a number of drawbacks, particularly the complexity and subsequent cost of the device which may put it out of range of many potential users. Also, this device may require a lengthy set-up and a high degree of skill to operate. It may not be able to get into corners or close to floors or ceilings and thus may not be able to be used in a complete vertical action from the top of the filler strip to the bottom. Because it includes a power tool, use of this device entails inherent risks for the operator, and little tolerance for error exists due to the device's scribing and cutting in one motion. This leads to a risk that, if a deep trim is made, the tool may "bite" into the material being trimmed and causing irreparable damage.

A large proportion of cabinetry uses filler strips that are simply held into position by a number of screws. These screws are normally placed from the inside of the carcass through to the outside of the carcass and into the side of the filler strip that butts up against the side of the carcass. The screw is then covered by a screw cap. In the case where the joinery may be seen on the inside, where a clean look of no screws being visible is desirable, the cabinet may be manufactured in the factory with the filler strip permanently fitted to the unit. This is then trimmed while still fitted to the unit, thus negating the need for a clamping and holding system for a filler strip as disclosed.

Granted U.S. Pat. No. 7,231,720 to Allen discloses a scribe for carpentry having an "edge follower upon which is mounted a sliding and stoppable instrument holder". The edge follower of the disclosed scribe is pointed in nature, and is thus unsuitable for use as a surface follower (i.e. a surface such as a floor, wall or ceiling surface). It is considered this is due, firstly, to a tendency of the marking instrument to rotate about the tip of the pointed edge follower as disclosed which may make the profile line transcribed by this tool inaccurate. Secondly, the edge follower may cause an undesirable mark if used as a reference surface follower. The structure of the device, which requires the use of a separate pen or pencil, may also prevent it from being able to be adequately adjusted in circumstances in which a small offset distance between the marking point and target surface are required.

U.S. Pat. No. 2,894,329 to MacDermid discloses a scribing tool with a "flat faced" line 69 column 1 lower surface and "scribing points" line 30 column 2. However, it is considered the discrete adjustment by way of the progressively stepped nature of the possible height positioning of the scribing points of the disclosed tool means the user has limited ability to control the height of the scribing point, and may thus unnecessarily waste material due to having to configure the device of MacDermid to a height that will generally exceed the offset height required. Small offset distances approaching 0 mm may, also not be achievable with this device. The MacDermid apparatus also suffers from the drawback that, when used in relation to a target surface that forms a corner either with itself, with other localised formations or with the reference surface, scribing right into an internal corner is not possible. The MacDermid tool may not be able to scribe all the way into an internal corner.

Other shortcomings of this device include the risk of the user accidentally marking the target surface with the incorrect marking point which is at a different height to the marking point intended to be used. Also, the method of setting the height of the marking point, which requires disassembly of the device, is time consuming and may allow parts of the device to become misplaced.

U.S. Pat. Nos. 7,254,855 and 6,941,605 B2 to McCreesh, disclose a multi-purpose hand tool for use by a carpenter/tradesman which can be used to "mark a piece of material 80 which needs to be fitted against an uneven surface" line 3 col 16. The tool disclosed features a pointed surface following portion and thus may be susceptible to error due to rotation by the user. The structure of the tool disclosed suggests a minimum distance between the reference surface and the marking portion of the tool of approximately 25 millimeters. This limited range of adjustability gives the tool a correspondingly large minimum material off cut, making it inefficient.

Two hands are required to adjust and operate the disclosed tool due to its elongated nature and the requirement for an independent marking or scribing element such as a pen or pencil.

U.S. Pat. No. 1,465,230 to Nikander defines a metal and wood-working trades tool capable of scribing a profile, in which the surface follower portion consists of a "scale blade" line 26 column 1. The blade like shape of the following portion makes it particularly unstable in the plane normal to the target surface and thus the marking point is likely to lift off the target surface during use. The tool may not have the capability to reference off a wall, floor or ceiling and transcribe a line onto cabinetry.

U.S. Pat. No. 2,786,274 to Early discloses a scribing tool suited for use in relation to "floor and wall coverings, countertop and sink coverings". The "tracing point" line 71 column 1 and "divider points" line 2 column 2 disclosed are either pointed or dual pointed. Use of the pointed portion as disclosed could lead to inaccuracy for the reasons already identified with other prior art devices. Use of the dual pointed follower portion may suffer from the same lack of stability of the blade-like follower disclosed by Nikander above. The dual pointed portion of this disclosure has the potential to cause damage to a floor or wall surface if the disclosed tool were used to transcribe the profile of this type of reference surface. The disclosed tool features a large minimum offset between the tracing point and the scribing point making it unsuitable for use with a small offset distance approaching 0 mm. The scribing point is relatively short in relation to the width of the blade of the tool, which may prevent the scribing point form being able to mark the profile completely and accurately onto irregular target surfaces.

U.S. Pat. No. 2,458,208 to Ruger discloses a form of scribing tool described as an "ellipsograph" line 38 column 1, which is suitable for the scribing of circles, "flattened ellipses" line 42 column 1 and straight lines. This tool is used in scribing a circle or ellipse onto a worksheet and is not suitable for transcribing a contour of a reference surface onto a target surface.

U.S. Pat. No. 4,656,744 to Decker discloses a scribe tool for use by carpenters to mark the profile of an irregular wall onto a wall panel. The user "grips the handle and the pencil and holder, and, while keeping the bar horizontal holds the point against the irregular wall" thus the tool requires two hands to use. The apparatus disclosed is thus unsuitable for use in circumstances where the user requires at least one hand to maintain balance over the range of the action with the tool, i.e. when working upon a ladder or in a prone stance on the floor. The pencil may easily lose its sharp point and thus accuracy. Also, being an individual component, the pencil may become separated from the device and misplaced.

U.S. Pat. No. 2,509,876 to Neiss (Neiss I) describes a scribing tool suitable for use in scribing flooring material. The minimum offset distance between the reference surface follower and the scribing point of the disclosed tool appears to be approximately 75-100 millimeters making this tool unsuitable for scribing for example a kick rail frame which may only be 75 millimeters high. The large diverging prongs of the reference surface follower of the Neiss I disclosure may mitigate damage to the wall or floor surface. However the width of the prongs of this device may prevent the scribing point from marking the profile all the way into the corner of an internally cornered reference surface. Also, the reference surface follower does not follow the reference surface where it contacts the target surface. This may lead to inaccuracy as the transcribed line is not based on the reference surface where the target surface actually comes into contact with it.

U.S. Pat. No. 2,553,812 to Cohen discloses a scriber directed at scoring linoleum with parallel lines via marking points or needles which are "exposed to the view of the operator in order to provide better working conditions and better accuracy" line 15 column 1. The device has a single point of contact with the reference surface and is thus unstable, permitting angular rotation resulting in inaccuracy of the scribed line. This tool may not be capable of scribing offset distances from 0 mm to approximately 3 mm, due to the reference surface follower design. An ability to mark these distances is important in providing an acceptable fit between the reference surface and the target surface.

U.S. Pat. No. 3,875,664 to Diner discloses a tile scribing tool for use between a wall reference surface and a tiled floor target surface, where the scribing tool "is of a width equal to the width of one of the tiles". This tool marks tiles with a cutting line that allows for infilling one row of tiles between the tile cutting line and the wall. The disclosed device, having a large, fixed offset distance between the wall follower wheels and the scribe point, is not suitable for profile transcription related to carpentry trades.

U.S. Pat. No. 2,581,179 to Eldh discloses a pattern scribing tool suitable for marking and cutting flooring materials. The distance between the "scribing point" line 24 col 2 or "sharpened scoring blade" line 18 column 2 of this disclosure is non-adjustable in relation to the "guide nub" line 9 column 2 portion. This may make the tool unsuitable for use in transcribing a surface profile onto target surface due to the unnecessary waste of material that would result as a consequence of not being able to adjust the distance between the tool's guide nub and scribing point.

U.S. Pat. No. 2,274,727 to Neiss (Neiss II) discloses a scribing and cutting device having a surface following portion that has a small area bearing against the reference surface, making the tool susceptible to rotation and thus inaccuracy. Further, the surface following portion, similar to other related art devices described herein, leads to instability of the device. The scribing point of the disclosed device is not able to be adjusted to be close to the reference surface, limiting the applicability of the tool. The width of the device prevents the scribing point from being able to mark all the way into the internal corners of a target surface. The overall length of the device suggests two hands may be required for use. The length requiring the use of two hands and number of moving parts may lead to inaccuracy due to a lack of rigidity.

U.S. Pat. No. 2,296,232 to Drain discloses a scribing tool for wall coverings. The tool disclosed scribes a mark upon the curved internal radius formed when a wall covering material, such as linoleum, extends around an internal corner. The range of adjustment of the scribing point is very limited and curved which means it may not be capable of contact with the target surface at a variable level, making the tool unsuitable for use in carpentry and cabinetry related applications.

Published Japanese Patent Abstract JP05146557 to Katsumi discloses a tool which is considered to have a fixed distance between the reference point and marking point and is unlikely to be able to scribe distances between 0 mm and approximately 100 mm. Further, it is considered that the tool disclosed in the abstract of Katsumi cannot scribe into a corner. In particular, contact members 22 and 24 rotatably supported about support point 20 are effectively hinged by a pin to the main body of the tool, therefore affecting the distance between the marking point and reference points, causing the distance to vary if not held steady albeit that the contact members 22 and 24 seem to be biased forward by what appears to be a spring member 28. Katsumi also lacks any facility for precision incremental adjustment. Moreover, the marking point of Katsumi appears offset to its reference point(s), therefore not necessarily giving a true image of the reference surface onto the surface to be marked.

Published UK Patent application GB2403924 is another attempt to record the profile of a surface. The tool disclosed in GB2403924 is not capable of scribing small dimensions, for example, 25 mm or less. The device also requires two hands to operate to keep it steady and, lacks stability, and therefore accuracy.

Generally, current methods used for scribing In the building Industry, for example in the field of cabinet making, have adopted "adhoc" methods that have had a number of draw backs. These include:

1) Problems with scribing into a corner.
2) Methods require the use of two hands, which prevents the user from having a free hand to assist with personal stability when in a prone position or able to hold and stabilise materials being scribed.
3) Inability to retrace a previously scribed line to make it more defined.
4) Difficulties in visualising a scribed line on dark coloured materials.
5) Dangerous methods used including the use of sharp exposed blades in close proximity to an unprotected hand.
6) An unstable reference surface follower, which leads to inaccurate reference lines being scribed onto the target surface.
7) Some methods damage the reference surface.

Furthermore, there is a need for a scribing tool that:

1) Is easy and simple to use by an untrained person.
2) Can be used with one hand, allowing a free hand to assist with personal stability when in a prone position or able to hold and stabilise materials being scribed.
3) Has the ability to scribe into internal corners.
4) Scribes from 0 mm upwards.
5) Has significant stability.
6) Allows user to accurately retrace a previous scribed line, permanently marks target surface.
7) Leaves a permanent and visible line on dark surfaces.
8) Prevents damage to reference surface due to the design of the reference point of the tool.
9) Visibly depicts the measurement height of the scribing tip from the reference surface.
10) Has multiple scribing tips.

SUMMARY OF INVENTION

An object of embodiments of the present invention is to provide an apparatus and method for transcribing a profile of a reference surface to a target surface.

It is also an object of the embodiments described herein to overcome or alleviate at least one of the above noted drawbacks of related art systems or to at least provide a useful alternative to the related art systems.

In a first aspect of embodiments described herein there is provided an apparatus for transcribing a profile of a reference surface to a target surface comprising:

at least one marking portion operatively associated with a reference surface following portion, the at least one marking portion extending laterally beyond the perimeter of the reference surface following portion and comprising at least one marking region forming an angle of 90° or less at its outer extent.

In another aspect of embodiments described herein there is provided an apparatus for transcribing a profile of a first reference surface to a second target surface comprising:

at least one first marking portion disposed relative to at least one second marking portion at an angle of 90° to 180°.

In a further aspect of embodiments described herein there is provided an apparatus for transcribing a profile of a reference surface to a target surface comprising:

a reference surface following portion and at least one marking portion, wherein the at least one marking portion is rotatably repositionable with respect to the reference surface following portion along an interconnecting shaft and the position of the at least one marking portion is lockable relative to the reference surface following portion.

In yet a further aspect of embodiments described herein there is provided a method of transcribing a profile of a reference surface to a target surface, the method comprising the steps of:

identifying a maximum gap between the reference surface and the edge of the target surface;

engaging a reference surface follower means with the reference surface;

rotating a target surface marker means relative to the reference surface follower means such that a separation between the target surface marker means and the reference surface follower means corresponds to at least the maximum gap;

maintaining the separation at a constant distance;

moving the reference surface follower means along the reference surface whilst maintaining contact between the target surface marker means and the target surface.

In a yet further aspect of embodiments described herein there is provided a method of manufacturing a profile transcription apparatus, the method comprising the steps of:

provision of at least one marking portion and a reference surface following portion; and provision of a threaded shaft means adapted for operative association with the at least one marking portion and the reference surface following portion, wherein the at least one marking portion is adapted for rotatable repositioning along the threaded shaft means.

In yet a further aspect of embodiments described herein there is provided apparatus for transcribing a profile of a reference surface to a target surface comprising; at least one marking portion coaxially positionable with respect to a reference surface following portion wherein the at least one marking portion is adapted to accommodate a zero offset between the reference surface and the target surface. Preferably, the at least one marking portion and the reference surface following portion of apparatus according to this aspect are adapted to engage with substantially orthogonal or perpendicular target and reference surfaces, respectively. Alternatively, the marking portion and reference surface following portion are adapted in other embodiments to engage with target and reference surfaces that may be disposed at acute or obtuse angles to each other.

In essence, the present invention stems from the realisation that providing a marking portion of a scribing tool which forms an angle of 90° or less at its outer extent and that extends laterally beyond the perimeter of a reference surface following portion of the scribing tool allows for a more accurate transcription of a profile and, in particular, a more complete transcription of the full extent of the profile. A further realization is that such a tool's safety and ease of use would be enhanced if the reference surface following portion comprised a planar surface which is relatively large compared to the perimeter of the tool. Yet a further realisation that has contributed to a more accurate and complete transcription of a profile is that a coaxially positionable relationship between the marking portion and the reference surface following portion allows for fine adjustment and an ability to transcribe even at points where the offset between the two surfaces approaches zero.

Other aspects and preferred forms are disclosed in the specification and/or defined in the appended claims, forming a part of the description of the invention.

Embodiments of the present invention are principally directed to in one aspect to an apparatus for transcribing a profile of a reference surface, such as a floor or wall, onto a target surface, such as a kick board, skirting board or filler strip, wherein a target surface marking portion of the apparatus is operatively associated with, and extends beyond, a reference surface following portion, the apparatus having a marking region which forms an angle of less than 90° at its outer extent. In another aspect, embodiments of the present invention are directed to a profile transcription apparatus wherein first and second marking portions are positioned at between 90° and 180° relative to each other. Certain embodiments are further directed to a profile transcription apparatus wherein a marking portion is repositionable with respect to a following portion along an interconnecting shaft, and is lockable at any point upon the interconnecting shaft.

A preferred embodiment is directed towards a method of transcribing a profile wherein a maximum gap between the reference surface and the edge of the target surface is identified, a reference surface following portion of a profile transcription apparatus is engaged with the reference surface, the marker means of the apparatus is rotated relative to the reference surface following portion such that the distance between the marker means and the reference surface following portion corresponds to the maximum gap, the separation between the marker means and the reference surface following portion is fixed and the apparatus is moved along the reference surface whilst maintaining contact between the marker means and the target surface.

Advantages provided by the present invention comprise the following:

- Ease of setting-up and maintaining of the distance between the marking portion and the reference surface following portion.
- Fine adjustment of the distance between the marking portion and the reference surface following portion is possible.
- The range of adjustment of the marking portion is suitable for small minimum gap circumstances.
- Ergonomics that make the apparatus and method simple and straight forward to perform.
- Accuracy of transcribed profile in relation to the reference surface.
- Avoidance of damage of the reference surface during use.

An ability to transcribe the profile to the entire target surface in situations of reduced accessibility to the target surface, such as encountered with internal corners.

Single hand use.

Increased user safety due to the freeing up of one hand for personal stability and the reduction of the user placing their body in prone positions.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which.

DETAILED DESCRIPTION

Figure 1:
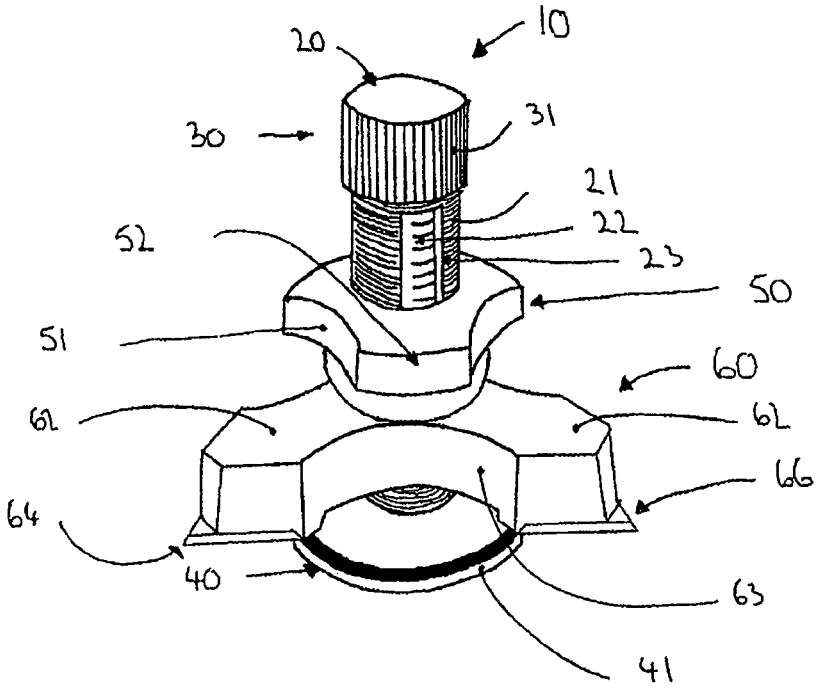
FIG. 1 illustrates a side perspective view of an apparatus for transcribing a profile in accordance with a preferred embodiment of the present invention.

FIG. 1 is a side perspective view of an apparatus for transcribing a profile, shown generally as 10, in accordance with an embodiment of the present invention. In the present embodiment, the apparatus is designed to transcribe a profile of a reference surface, such as a wall, floor or ceiling onto a target surface such as a part of a cabinet, or a bench top. Ordinarily a target surface may be disposed at right angles (or 90°) to the reference surface. However, it is envisaged that preferred embodiments of the present invention may be applicable to the transcription of a profile from a reference surface to a target surface where the two respective surfaces are non-perpendicular.

The apparatus comprises a rigid cylindrical shaft 20 which features an external thread 21. The shaft 20 may be formed from machined metal material, with or without suitable surface finishes, or may be another suitable material such as moulded plastic, or combination of materials. The shaft 20 may further comprise a measurement scale 22. The measurement scale 22 may be integral to the shaft, or it may be a separate component affixed Into a recessed slot 23 in the shaft 20, by any suitable means as would be understood by those skilled in the art.

The elevated or 'proximal' end of the shaft 20 comprises a gripping portion 30, which is typically integral with the shaft and may be provided with a high friction surface 31. The high friction surface 31, is preferably integrally formed from the material of the gripping portion 30, but it may alternatively be an applied material. This high friction surface 31 reduces the likelihood of slippage occurring between the user's hand (not shown) and the gripping portion 30 and thus improves a user's control of the shaft 20.

The lower or 'distal' end of the shaft 20 comprises a reference surface following portion 40, which is typically shaped to offer a smooth, relatively large contact area to bear against the reference surface. The reference surface following portion 40 may be integral with the shaft 20, or it may be a separate part affixed to the shaft by an appropriate form of connection, such as adhesive or a mechanical fastener. This connection may rigidly fix the reference surface following portion 40 to the shaft 20, or may allow the reference surface following portion 40 to rotate relative to the shaft 20.

The reference surface following portion 40 typically features a cover 41. The material of the cover 41 is characterized by low surface friction and non-marking properties. The cover 41 flay be permanently attached to the reference surface following portion 40 or may be removable.

The apparatus further comprises an internally threaded locking portion 50, and an internally threaded marking portion 60, each engaged upon the shaft 20.

The locking portion 50 is engaged upon the shaft 20 adjacent to the gripping portion 30. The marking portion 60 is engaged upon the shaft 20 adjacent to the reference surface following portion 40. It is envisaged that the relative positioning can be changed such that the locking portion 50 is adjacent the reference following portion 40, and the marking portion 60 is adjacent the gripping portion 30, with the same final result being achieved.

The gripping portion 30 and the reference surface following portion 40 can serve to prevent the locking portion 50 and the marking portion 60 from becoming detached from the shaft 20.

As will be readily understood by those skilled in the art, the locking portion 50 and the marking portion 60, being threadably engaged with the shaft 20, may each be individually rotated about the axis of the shaft 20, resulting in a longitudinal (and/or relative) movement of the portions along the axis of the shaft 20.

The locking portion 50 comprises a generally disc shaped body being internally threaded along its central axis, this axis corresponding to the central axis of the shaft 20 when the locking portion 50 is engaged upon the shaft 20. The locking portion 50 may be manufactured from a single material such as aluminium or may be manufactured by other suitable means as would be familiar to those skilled in the art.

The locking portion 50 further comprises a turning surface 51, which Is typically integrally formed with the locking portion 50 and may feature one or more lobes 52, and/or may be provided with a suitable alternative or additional finish to improve the user's ability to rotate the locking portion 50.

The marking portion 60 is generally disc shaped and internally threaded along its central axis, this axis corresponding to the central axis of the shaft 20 when the marking portion 60 is engaged upon the shaft 20. The marking portion 60 may be manufactured from a single material such as aluminium or may be manufactured by other suitable means as would be familiar to those skilled in the art.

The marking portion 60 further comprises one or more marking regions 62. Preferably three marking regions 62 are utilised. Marking regions 62 are typically co-planar and extend radially outwards from the common central axis of the marking portion 60 and the shaft 20. Preferably, the marking regions 62 are spaced evenly and symmetrically about the axis of the shaft 20, the marking regions 62 thus giving the apparatus 10 the general form of an equilateral triangle shaped outside perimeter as viewed from above.

Intermediate the marking regions 62 are holding surfaces 63. Preferably, the holding surfaces 63 are inwardly scalloped in. shape. During the scribing operation the user imparts motion to the apparatus substantially via the holding surfaces 63.

Marking regions 62 feature scribing tips 64. Scribing tips 64 may be separate, removable scribing elements 66 as illustrated in FIG. 1 or, alternatively, they may be integrally formed (not shown). As would be appreciated by the person skilled in the art, integral formation of the scribing tips 64 with the marking regions 62 may offer reduced manufacturing cost. Preferably however, separate, removable scribing elements 66 are utilised. This approach allows the removable scribing elements 66 to be formed from a material suitable for, acting as a scribing edge or point, such as hardened steel for example. Removable scribing elements 66 may be readily exchanged if they become damaged or blunt. Preferably, the marking regions 62 of the apparatus 10 are adapted to utilise removable scribing elements 66 that are of a standardised design and are thus cost effective and widely available in the carpentry and cabinetry trade. Alternatively, it is envisaged that the scribing elements may comprise customised blades where the blades may include counter sunk apertures for accommodating counter sink screws as this may contribute to the stability of fixture of the blades to the tool and also the general aesthetic appearance of the tool. Further the counter sink nature allows for the tool to accommodate offsets between the reference and target surfaces that approach zero.

Figure 2:
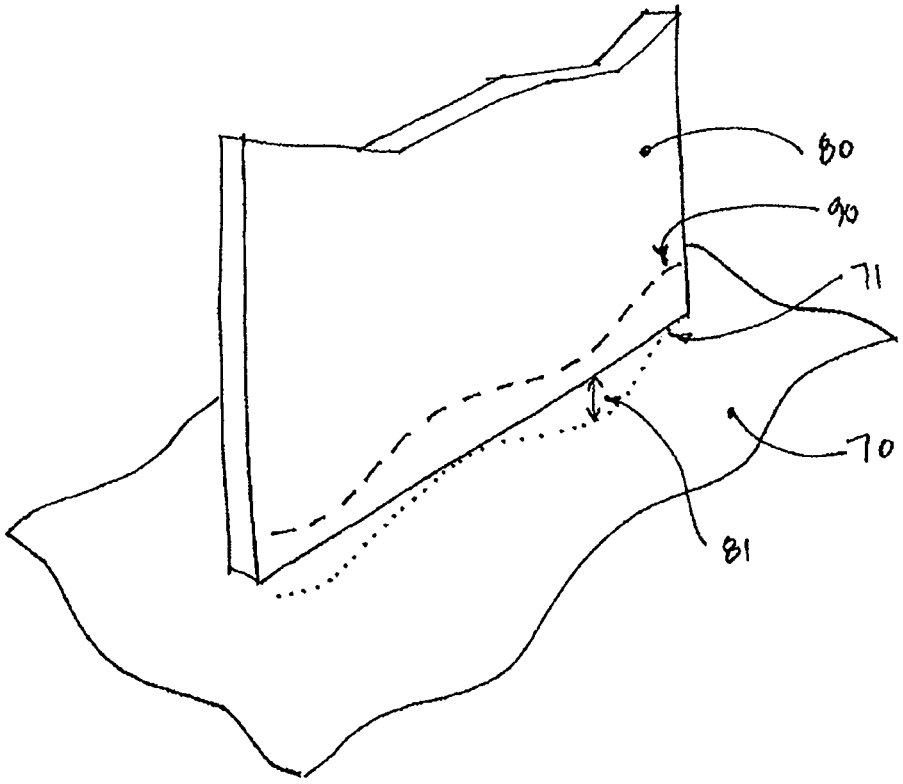
FIG. 2 illustrates a perspective view of a reference surface and target surface.

FIG. 2 is a perspective view of a reference surface 70 such as a floor, wall or ceiling, and a target surface 80 such as a cabinetry kick rail, bench top or vertical seen end panel.

Identification of the maximum gap distance 81 is the first step in the preferred method of transcribing a reference surface profile 71 to target surface 80.

The profile transcription apparatus in accordance with the embodiment of the present invention as shown in FIG. 1 is engaged with the reference surface 70 generally at the location of the maximum gap distance 81, with the reference surface following portion 40 abutting the reference surface 70. The shaft 20 is oriented normal to the reference surface 70.

The shaft 20 is gripped at its gripping portion 30 and its position is stabilised by reference surface follower means for example, the reference surface follower portion 40. The marking portion 60 is rotated until the level of a scribing tip 64 approximately equals, or preferably slightly exceeds, the maximum gap distance 81. The locking portion 50 is then brought into contact with, and counter rotated against, the marking portion 60, thus maintaining the marking portion 60 and the reference surface following portion 40 at a constant distance. The apparatus 10 is then moved laterally across the reference surface 70 maintaining contact between the scribing tip 64 and the target surface 80. The lateral action of the scribing tip 64 against the target surface 80 marks a transcribed profile line 90 upon the target surface 80 that follows the reference surface profile 71 of the reference surface 70.

Figure 3:
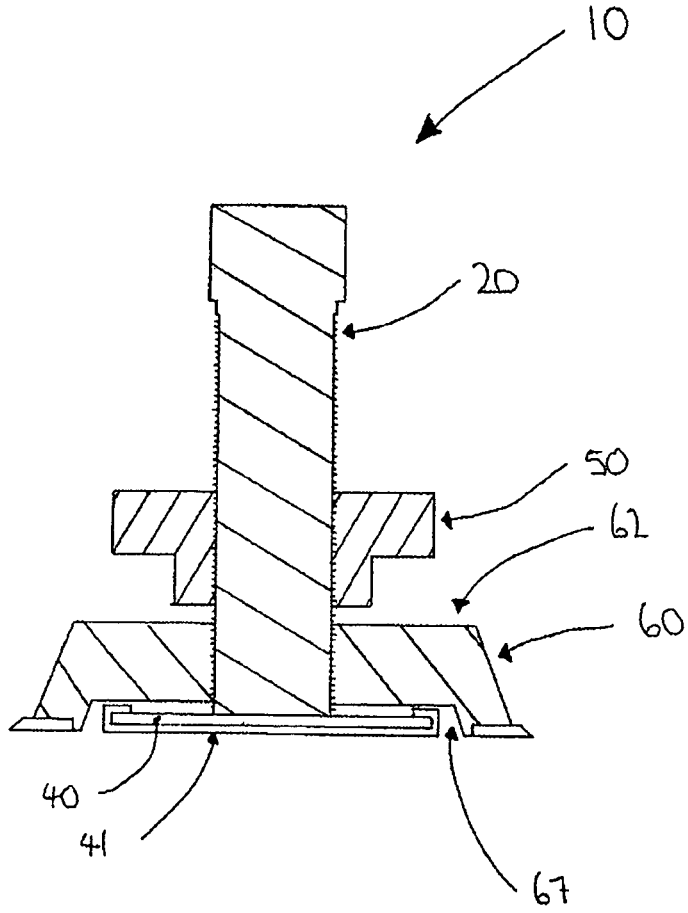
FIG. 3 illustrates a side sectional view of the apparatus of FIG. 1.

FIG. 3 is a side sectional view of a profile transcription apparatus, shown generally as 10, in accordance with an embodiment of the present invention. In this preferred embodiment, the marking portion 60 further comprises a recess 67 located at the 'distal' surface, being the surface adjacent to the reference surface following portion 40. As depicted, the recess 67 allows the second internally threaded portion 60 to be threadably moveable to a position in which the marking regions 62 are coplanar with the 'distal' surface of the reference surface following portion 40 and cover 41. This gives the apparatus 10 the ability to transcribe profile lines in circumstances where the maximum gap distance 81 is relatively small. This requirement may arise where relatively little, variation in the reference surface profile exists.

Figure 4:
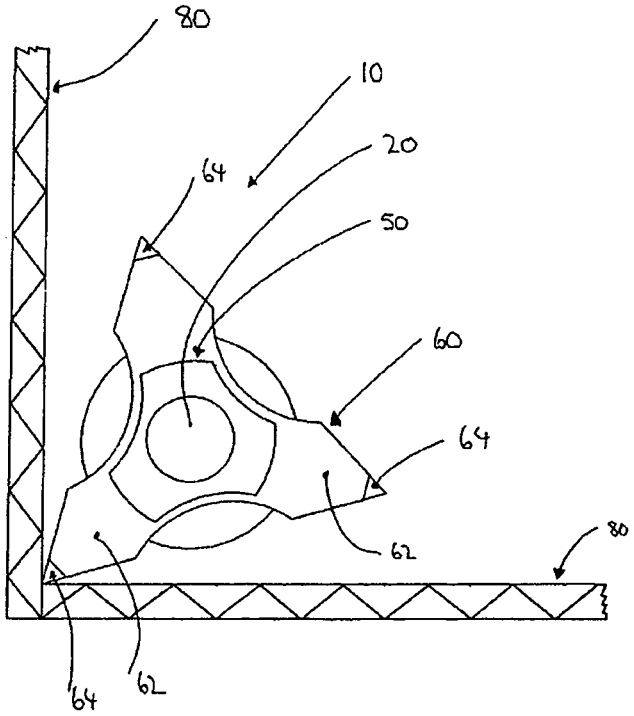
FIG. 4 illustrates a plan view of the apparatus of FIG. 1, whilst in use for a preferred application of the apparatus of FIG. 1.

FIG. 4 is a plan view of a profile transcription apparatus, shown generally as 10, in accordance with an embodiment of the present invention. In a preferred embodiment, the apparatus 10 features three marking portions 62. The figure depicts the profile transcription apparatus 10, the outer extent of which is defined by three marking regions 62 each forming 60° degree angles. The angular shape of the outer extent of the apparatus 10 thus enables the scribing tips 64 to mark the profile all the way into an internal corner as illustrated.

In one particular application of an apparatus according to a preferred embodiment, when fitting a kick rail (the base rail that the cupboards sit on) it is generally required to be level as this is the foundation for the cupboards and bench tops. To fit a kick rail, it may first be placed on the floor and a spirit level may be used to level it kohl left to right and from front to back. If the floor is not level, the kick rail may be held in a temporary level position by the installer using a series of fillers/packers of different thicknesses placed under the kick rail to hold it in that level position. The thickness of the gap between the floor and the kick rail may vary depending on the undulations and levelness of the floor. The next stage requires the installer to transcribe the floor undulations and levelness onto the kick rail. This is done by first finding the maximum gap distance 81 as shown in FIG. 2, between the floor and the underside of the kick rail. Depending on the state of the floor and length of the kick rail, this gap could be from less than 1 millimeter to over 25 millimeters.

Once the maximum gap distance 81 is determined the installer may simply undo the locking portion 50 of the apparatus 10, as shown in any one of FIG. 1, 3 or 4, then place the reference surface following portion 40 on the floor next to the maximum gap distance 81 and simply rotate the marking portion 60 of the tool up or down until the bottom side of one of the three scribing tips 64 is level with the underside of the kick rail. The user may now tighten the locking portion 50 so it is firm against the marking portion 60. The apparatus 10 is now ready to mark the kick rail.

Alternatively, the installer may measure the maximum gap distance 81 between the floor and underside of the kick rail with a ruler. The measurement can now be applied to the apparatus 10, by simply rotating the marking portion 60 to correspond to the measurement scale 22 on the shaft 20.

The apparatus 10 is now ready for use with either the left or right hand. Starting at one end of the kick rail, the installer may hold the apparatus 10 firmly with the reference surface following portion 40 on the floor. The user ensures that they have one of the scribing tips 64 making contact with the surface of the vertical surface of the kick rail. Preferably, the apparatus 10 is held at 90° to the kick rail. This is easily done by visualizing an imaginary line through the centre of the shaft 20 to the centre of the scribing tip 64 that is making contact with the kick rail. The user ensures that imaginary line is at 90° to the kick rail. The user now places enough pressure on the apparatus 10 so the reference surface following portion 40 is firm against the floor and so the scribing tip 64 may scratch a line onto the vertical surface of the kick rail.

The user now slowly slides the apparatus 10 along the floor and scratches a line onto the vertical surface of the kick rail by applying even pressure on the scribing tip 64. The user ensures that they have marked all parts of the kick rail that are to be fitted to the floor. The user can repeat this motion until satisfied that the line that has been scratched/scribed onto the kick rail surface. The profile of the floor is now transcribed onto the kick rail. The kick rail can now be trimmed, with an electric plane or jigsaw or by any other method, to the scribed line on the kick rail. Once trimmed, the kick rail can now fit to the floor.

This process is also used when fitting vertical seen end panel that comes into contact with a wall or floor or both.

A similar process may be used for fitting bench tops up against walls and filler strips between cupboards and walls.

When fitting a bench top to the surrounding walls, the bench top is set so it is parallel or square to the front and/or ends of the cupboards. There may be an overhang of the bench top at the front and end of the cupboard depending on the look and application trying to be achieved. Once the bench top is set in the desired position, the same process of finding the maximum gap distance 81 is utilized, but this time it is between the edge of the bench top and the wall. Once the maximum gap distance 81 is determined the user may simply undo the locking portion 50 on the apparatus 10, then place the apparatus 10 reference surface follower portion 40 on the wall next to the maximum gap distance 81. The installer may have the cover 41 fitted to prevent marking the wall.

Now the user simply rotates the marking portion 60 of the apparatus 10 up or down until the bottom side of one of the three scribing tips 64 is level with the edge of the bench top. The user then may tighten the locking portion 50 so it is firm against the marking portion 60. The apparatus 10 is now ready to mark the bench top.

Alternatively, the installer may measure the maximum gap distance 81 between the wall and the edge of the bench top with a ruler. The measurement can now be applied to the apparatus 10, by simply rotating the marking portion 60 to correspond to the measurement scale 22 on the shaft 20.

The apparatus 10 is now ready for use with either the left or the right hand. Starting at one end of the bench top, the installer holds the apparatus 10 firmly with the reference surface following portion 40 on the wall. The user ensures that they have one of the scribing tips 64 making contact with the surface of the bench top. Preferably, the apparatus 10 is held at 90° to the bench top. This is easily done by visualizing an imaginary line down from the centre of the shaft 20 to the centre of the scribing tip 64 that is making contact with the bench top. The user ensures that imaginary line is at 90° to the bench top. The user now places enough pressure on the apparatus 10 so the reference surface following portion 40 is firm against the wall and so the scribing tip 64 may scratch a line onto the horizontal bench top surface.

The user now slowly slides the apparatus 10 along the bench top and scratches a line onto the bench top surface by applying even pressure on the scribing tip 64. Preferably, the installer should ensure they only mark the bench top where it is to come into contact to the wall once fitted. The user can repeat this motion until satisfied with the line that has been scratched/scribed onto the bench top surface. The profile of the wall is now transcribed onto the bench top. The bench top can now be trimmed, with an electric plane or jigsaw or by any other method as would be recognized by the person skilled in the art, to the scribed line on the bench top. Once trimmed, the bench top can now fit to the wall.

Another component that may be fitted to walls, floors and ceilings is a filler strip. Rather than having a cabinet carcass butt directly up against a wall, a filler strip may be utilized for a cleaner finish, plus allowing it to be fitted to the shape of the wall floor or ceiling. In most cases this may be fitted to an already leveled part of the cabinetry, as filler strips are one of the finishing touches to the fitting process. The filler strip in most cases is fixed to parts of the cabinetry, e.g. a cabinet carcass, that is to be fixed parallel to a wall, generally within 16-20 millimeters of the wall. With the carcass sitting on a level kick rail, it is slid until the filler strip butts hard up against the wall. If there are no gaps, the cabinet carcass may then be fixed to the kick rail and/or wall. However if there is a gap, the maximum gap distance 81 is found. Once the maximum gap distance 81 is determined, the installer simply undoes the locking portion 50 of the apparatus 10, then places the reference surface following portion 40 on the wall next to the maximum gap, distance 81. Again, the installer takes care to affix the cover 41 to the reference surface follower portion 40 in order to avoid damage or marking of the wall.

Now the user simply rotates the marking portion 60 of the apparatus 10 up or down until the bottom side of one of the three scribing tips 64 is level with the edge of the filler strip that is closest to the wall. The user then may tighten the locking portion 50 so it is firm against the marking portion 60. The apparatus 10 is now ready to mark the filler strip.

Alternatively, the installer may measure the maximum gap distance 81 between the wall and the edge of the filler strip with a ruler. The measurement can now be applied to the apparatus 10, by simply rotating the marking portion 60 to correspond to the measurement scale 22 on the shaft 20.

The apparatus 10 is now ready for use with either the user's left or right hand. Starting at one end of the filler strip, the installer holds the apparatus 10 firmly with the reference surface following portion 40 on the wall. The user ensures that they have one of the scribing tips 64 making contact with the surface of the filler strip. Preferably the apparatus 10 is held at 90° to the filler strip. This is easily done by visualizing an imaginary line across from the centre of the shaft 20 to the centre of the scribing tip 64 that is making contact with the filler strip. The user ensures that imaginary line is at 90° to the filler strip. The user now places enough pressure on the apparatus 10 so the reference surface following portion 40 is firm against the wall and so the scribing tip 64 may scratch a line onto the filler strip surface.

The user now slowly slides the apparatus 10 along the wall and scratches a line onto the filler, strip surface by applying even pressure on the scribing tip 64. Preferably, the installer should ensure they only mark the filler strip where it is to come into contact to the wall once fitted. The installer can repeat this motion until satisfied with the line that has been scratched/scribed onto the filler strip surface. The profile of the wall is now transcribed onto the filler strip surface. The filler strip can now be trimmed, with an electric plane or jigsaw or by any other method as would be recognized by the person skilled in the art, to the scribed line. Once trimmed, the filler strip can now fit to the wall.

The above process can also be used for fitting filler strips to a floor or ceiling.

Due to the design of the tool as shown in FIG. 4, it is not possible to keep the scribing tips 64 at 90° to the surface being scribed when you get within approximately 30 millimeters of a corner. In these circumstances it is acceptable to pivot the scriber tool on its reference surface follower portion 40, and scribe a line onto the surface for the short distance that is remaining to be scribed into the extent of the corner.

The above methods can be used on a wide variety of materials including and not limited to timber, particle board, Medium Density Fibreboard (MDF), laminate, stone, stainless steel, linoleum and other materials used in the building trade.

The above gives examples of uses for the fitting of cabinets, however the preferred apparatus could be applied to a number of other applications in the building industry including but not limited to:

Fitting materials around other shaped materials.

Linoleum installation around pillars in buildings.

Tiling installation.
Sheet metal fabrication.
Stone installation.
Carpet Installation.
Laminated bench top surface installation.
Fitting skirting boards to floors.
Fitting architraves to walls where the gap between the door frame and wall is too-narrow to accommodate the width of the prefinished architrave, therefore requiring it to be trimmed back.

Depending on methods employed by the user, on occasions the apparatus 10, as shown in FIGS. 1, 3 and 4 may also be used for scribing the top, left and right edges of a door when it is being fitted to a door frame containing no architraves. Generally when fitting a door and door frame, the first item to be fitted to the stud frame of the house is the door frame. The stud frame opening is typically wider that the outside diameter of the door frame. This is done to allow for the level fitting of the door frame. The door frame is placed inside the stud opening and one side is fixed to the stud frame level and straight. Packers are generally used up each side of the door frame, between the stud and outside of the door frame to assist with the levelling of the frame and ensuring the vertical edge is also straight. The opposite side is then fixed in the same manner, with the user ensuring the inside opening of the door frame is parallel and the top of the frame is also level.

Once the door frame is fitted, the next item to be fitted is the door into the door frame cavity. Generally door. frames are fitted to accommodate a predetermined size door which is widely commercially available. These doors on first installation may fit tight inside the door frame. If not, small wedges could be utilized to hold the door inside the door frame. The user now has to mark the door so it can be planed back so it has even gaps of approximately 3-4 millimeters between the door and the door frame along, the left, right and top of the door. The apparatus 10 can be adapted by use of an additional reference surface follower portion that may be packaged with the apparatus 10, when sold. This additional reference surface follower portion is preferably wider in diameter than the reference surface following portion 40, giving it the ability to be hooked over the outside edge of the door frame. This hooking motion is possible due to the door jams being packed out away from the stud frame, therefore creating a gap for free movement of the additional reference surface follower portion. In this instance, the top side of the additional reference surface follower portion is being used to transcribe the profile of the door jam. The user can now run the apparatus 10 along the left, top and right of the door frame, marking a 3-4 millimeter line that the door can now be trimmed to.

The apparatus 10, as shown in FIGS. 1, 3 and 4 may also be used for transcribing the profile of floor surfaces, such as polished concrete, tiles or floor boards onto skirting boards.

In these circumstances the user cuts the skirting board to the desired length and places it into position against the floor and wall. The next stage requires the user to transcribe the floor undulations onto the skirting board. This is done by first finding the maximum gap distance 81 as shown in FIG. 2, between the floor and the underside of the skirting board. Depending on the state of the floor and length of the skirting board this gap could be from less than 1 mm to over 10 mm.

Once the maximum gap distance 81 is determined the user may simply undo the locking portion 50 of the apparatus 10, as shown in any one of FIG. 1, 3 or 4, then place the reference surface following portion 40 on the floor next to the maximum gap distance 81 and simply rotate the marking portion 60 of the tool up or down until the bottom side of one of the three scribing tips 64 is level with the underside of the skirting board. The user may now tighten the locking portion 50 so it is firm against the marking portion 60. The apparatus 10 is now ready to mark the skirting board.

Alternatively, the installer may measure the maximum gap distance 81 between the floor and underside of the skirting board with a ruler. The measurement can now be applied to the apparatus 10, by simply rotating the marking portion 60 to correspond to the measurement scale 22 on the shaft 20.

The apparatus 10 is now ready for use with either the left or right hand. Starting at one end of the skirting board the installer may hold the apparatus 10 firmly with the reference surface following portion 40 on the floor. The user ensures that one of the scribing tips 64 is in contact with the surface of the skirting board. Preferably, the apparatus 10 is held at 90° to the skirting board. This is easily done by visualizing an imaginary line through the centre of the shaft 20 to the centre of the scribing tip 64 that is making contact with the skirting board. The user ensures that Imaginary line is at 90° to the skirting board. The user now places enough pressure on the apparatus 10 so the reference surface following portion 40 is firm against the floor and so the scribing tip 64 may scratch a line onto the vertical surface of the skirting board.

The user now slides the apparatus 10 along the floor and scratches a line onto the vertical surface of the skirting board by applying even pressure on the scribing tip 64. The user can repeat this motion until satisfied that the line has been scratched/scribed onto the skirting board surface. The profile of the floor is now transcribed onto the skirting board. The skirting board can now be trimmed, with an electric plane or jigsaw or by any other method, to the scribed line on the skirting board. Once trimmed, the skirting board will now substantially fit the undulations in the floor and may be fixed in place.

Commercial advantages of the apparatus in accordance with preferred embodiments are as follows:

Single handed use.
Extremely accurate.
Ease of use.
Can be used for multiple applications.
Could be used by multiple industries.
Attractive design.
Low cost tool to manufacture allowing profitable margins.
Potential to target the world wide building industry.
Robust.
Takes out the dangers of using exposed sharpened knife blades.
Takes away the clumsiness of previous scribing techniques.
Ability to retrace a line with accuracy.
Ability to support the ongoing use of the tool by providing consumable elements and other interchangeable components for the tool e.g. new scribing blades and spare parts.
Due to the blade shape, this creates an indentation onto the target surface that can assist with the prevention of chipping that can be caused when cutting/planing against the grain of timbers, painted or laminated surfaces Scribing is considered a difficult and awkward task and one to avoid. The use of two hands can be restrictive and frustrating. When using a ball point pen, it is difficult to get the tip of the pen sitting exactly on the top of the packers, so it can be necessary to make a slight allowance in the thickness of packers for this. Then in some cases the pen could stain the materials. When using a pencil it may go blunt and the tip of, the pencil may get wider. The other problem with using two hands is that sometimes the pen or pencil may slip over the packers, particularly if the packers got caught on the surface it was sliding on and the pen or pencil may slide off due to both hands moving at different speeds. Using two hands is also very difficult when it comes to scribing into corners. This becomes even more difficult depending on body positions of the user e.g. standing on a ladder or crouching on the floor. When it comes to actually trimming the item to the scribed line, it may never be accurate enough due to the previous methods of scribing just not being accurate enough. A simpler and far more effective way of scribing has been warranted and preferred embodiments provide this.

Various modifications and equivalent arrangements are intended to be included within the spirit and scope of the invention and appended claims. Therefore, the specific embodiments are to be understood to be illustrative of the many ways in which the principles of the present invention may be practiced. For example, the reference surface following portion may comprises a recess adapted to receive the marking portion therewithin such that a scribing tip of the marking portion is located proximate a central longitudinal axis shared by the reference surface following portion and the marking portion. This provides for a relatively low clearance for the scribing tool to be used in difficult configurations such as tight internal corners. Another arrangement is applicable to situations where an additional structure such as an external corner may be disposed at or adjacent the intersection of the reference and target surfaces. In order to adapt the device as shown in FIGS. 1 and 3 to such an occurrence a foot plate (not shown in the figures) may be included with the reference surface following portion. The foot plate may comprise a first section and a second section angled with respect to the first section. The first section is adapted for extending the second section over and above an additional structure such as an external corner adjacent the intersection of the reference and target surfaces. The second section may then extend from the first section towards the target surface, and preferably comprises a recess for substantially accommodating the marking portion within the extent of the second section itself. In this way, the function of the tool may be utilised, for example, to transcribe the profile of the reference surface to target surfaces at a height or distance that is beyond an obstruction such as cornice or corners.

In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly. requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

I claim:

1. Apparatus for transcribing a profile of a reference surface to a target surface comprising; at least one marking portion operatively associated with a reference surface following portion, the at least one marking portion extending laterally beyond the perimeter of the reference surface following portion and comprising at least two marking region having a scribing tip formed at an angle of 90° or less in a plane perpendicular to the target surface, and wherein the at least one marking portion is adapted for positioning the at least two marking regions in co-planar relationship with the reference surface following portion and wherein the marking regions are separated by an angle of about 120°.

2. Apparatus for transcribing a profile of a first reference surface to a second target surface, the apparatus comprising; at least one first marking portion disposed relative to at least one second marking portion at an angle in the range of 90° to 180° and wherein the at least one marking portion is adapted for positioning the at least one marking region in co-planar relationship with a reference surface following portion.

3. Apparatus as claimed in claim 2 wherein the reference surface following portion is configured to have a scribing tip of the marking portion located adjacent the reference surface following portion and operative around a central longitudinal axis shared by the reference surface following portion and the marking portion.

4. Apparatus as claimed in claim 2 wherein the marking portion has a first section and a second section angled with respect to the first section, where:

the first section is adapted for extending the second section over an additional structure adjacent the intersection of the reference and target surfaces, and;

the second section extends from the first section towards the target surface, and is configured to have the marking portion adjacent the second section for marking the target surface.

5. Apparatus as claimed in claim 2 wherein the at least one marking portion and the reference surface following portion are adapted to engage with target and reference surfaces, which are:

substantially orthogonal.

6. Apparatus as claimed in claim 2 wherein the at least one marking portion and the reference surface following portion are adapted to engage with target and reference surfaces, which are disposed at an acute angle to each other.

7. Apparatus as claimed in claim 2 wherein the at least one marking portion and the reference surface following portion are adapted to engage with target and reference surfaces, which are disposed at an obtuse angle to each other.

8. Apparatus for transcribing a profile of a reference surface to a target surface comprising; a reference surface following portion and at least one marking portion, wherein:

the at least one marking portion is rotatably repositionable with respect to the reference surface following portion along an interconnecting shaft and the position of the at least one marking portion is lockable relative to the reference surface following portion at any point along the interconnecting shaft, and wherein the at least one marking portion is coaxially positionable with respect to the reference surface following portion and wherein the at least one marking portion is adapted to accommodate a zero offset between the reference surface and the target surface.

9. Apparatus as claimed in claim 8 wherein the reference surface following portion is configured to have a scribing tip of the marking portion located adjacent the reference surface following portion and operative around a central longitudinal axis shared by the reference surface following portion and the marking portion.

10. Apparatus as claimed in claim 8 wherein the marking portion has a first section and a second section angled with respect to the first section, where:

the first section is adapted for extending the second section over an additional structure adjacent the intersection of the reference and target surfaces, and;

the second section extends from the first section towards the target surface, and is configured to have the marking portion adjacent the second section for marking the target surface.

11. Apparatus as claimed in claim 8, wherein the at least one marking portion and the reference surface following portion are adapted to engage with target and reference surfaces, which are:

substantially orthogonal.

12. Apparatus as claimed in claim 8 wherein the at least one marking portion and the reference surface following portion are adapted to engage with target and reference surfaces, which are disposed at an acute angle to each other.

13. Apparatus as claimed in claim 8 wherein the at least one marking portion and the reference surface following portion are adapted to engage with target and reference surfaces, which are disposed at an obtuse angle to each other.

* * * * *

UNITED STATES PATENT AND TRADEMARK OFFICE

CERTIFICATE OF CORRECTION

PATENT NO. : 8,819,948 B2
APPLICATION NO. : 13/383607
DATED : September 2, 2014
INVENTOR(S) : Peter Anthony Chamberlain It is certified that error appears in the above-identified patent and that said Letters Patent is hereby corrected as shown below:

On the title page in (73) Assignee: delete "Thingamajig" and insert --Thingamejig-- Pty Ltd, Torquay (AU)

Signed and Sealed this
Twenty-seventh Day of January, 2015

Michelle K. Lee

Michelle K. Lee
*Deputy Director of the United States Patent and Trademark Office*